US005480019A

United States Patent [19]

Furuya

[11] Patent Number: 5,480,019

[45] Date of Patent: Jan. 2, 1996

[54] COIN-DISTINGUISHING METHOD AND APPARATUS THEREFOR

[75] Inventor: Yonezo Furuya, Hiki, Japan

[73] Assignee: Nippon Conlux Co., Ltd., Tokyo, Japan

[21] Appl. No.: 147,054

[22] Filed: Nov. 3, 1993

[30] Foreign Application Priority Data

Nov. 11, 1992 [JP] Japan ..... 4-300928

[51] Int. Cl.[6] ..... G07D 5/08

[52] U.S. Cl. ..... 194/318

[58] Field of Search ..... 194/317, 318, 194/319, 334

[56] References Cited

U.S. PATENT DOCUMENTS

| | | | |
|---|---|---|---|
| 5,033,603 | 7/1991 | Kai et al. | 194/334 |
| 5,078,252 | 1/1992 | Furuya et al. | 194/318 |
| 5,263,566 | 11/1993 | Nara et al. | 194/318 |

FOREIGN PATENT DOCUMENTS

| | | | |
|---|---|---|---|
| 0480736 | 4/1992 | European Pat. Off. | 194/317 |
| 91/06074 | 5/1991 | WIPO | 194/317 |

*Primary Examiner*—F. J. Bartuska
*Attorney, Agent, or Firm*—Loeb and Loeb

[57] ABSTRACT

The present invention provides a coin-identifying method that is fast and that can reject any counterfeit coin that closely resembles a genuine coin, or a counterfeit coin that has a distribution that partially overlaps into a genuine-coin identification region, without reducing the acceptance ratio of genuine coins. It also provides an inexpensive apparatus that utilizes this method. The method and apparatus of the present invention perform a identification in which a first region is set to define a comparison reference for values measured by a first sensor and a second sensor that detect characteristics of a coin, a second region is set in such a manner as to partially overlap the first region, a preliminary identification is performed using this second region to determine whether the coin is a counterfeit. If the identification result is such that the coin is not determined to be a counterfeit, the first region is then used for further identification.

14 Claims, 5 Drawing Sheets

COIN-DISTINGUISHING METHOD AND APPARATUS THEREFOR

INDUSTRIAL FIELD

The present invention relates to a method of distinguishing between genuine and counterfeit coins and an apparatus therefor, and, in particular, to an electronic coin authenticity identification method.

BACKGROUND OF THE INVENTION

For a long time, it has been standard to identify the authenticity of coins by using mechanical means such as a permanent magnet, and recently also electronic means, as a means of identifying the material quality and other properties of coins.

In such an apparatus, a coin sensor is provided along a coin path that is arranged within the coin-identifying apparatus, the electromagnetic characteristics of a coin falling down this coin path is checked, and the authenticity of the coin is determined therefrom.

One type of coin sensor that is used is an excitation means for magnetizing the coin and a means that detects the electromagnetic response of the magnetized coin, and the value detected in this way is analyzed to identify the authenticity of the coin.

One example of the conventional electronic coin-identifying means that could be cited is Japanese Patent Laid-Open No. 1989–193988 (Laid Open date: Aug. 3, 1989). Japanese Patent Laid-Open No. 1989–193988 discloses a method for rejecting counterfeit coins that closely resemble genuine coins.

A conceptual diagram of the prior art technique disclosed by Japanese Patent Laid-Open No. 1989–193988 is shown in FIG. 7. This figure illustrates the condition of a partial intrusion into a genuine-coin identification region 12 (solid lines) of a counterfeit distribution region 13 (broken lines). A triangular rejection region (shown hatched in the figure) is provided in order to identify and reject test coins that partially intrude into the genuine-coin identification region 12, and calculations are performed using function equations in order to determine whether or not test coins lie within the genuine-coin identification region. Each test coin is determined to be either genuine or a counterfeit by comparing the results of these calculations with predetermined reference values for specific denominations.

PROBLEM TO BE SOLVED BY THE PRESENT INVENTION

In the identification method in accordance with this prior art, the area of the rejection region (the triangular portion shown hatched) is big in comparison with the area of the genuine-coin identification region 12 (solid lines), and, as a result, the ratio of genuine coins that are accepted is low and also complicated and expensive circuitry is necessary to perform the calculations using function equations.

Even if these calculations using function equations are entrusted to a configuration that uses a device such as a CPU, which has become common recently, it is inevitable that the number of program steps required will increase. If a cheap CPU is used, it is particularly difficult to reduce the number of program steps required, and also the processing speed of a cheap CPU is slow so that the time taken to calculate the function equations will affect the acceptance of genuine coins.

These are some of the problems with the prior art technique.

SUMMARY OF THE INVENTION

In consideration of the above problems, an objective of the present invention is to provide a coin-identifying method that is fast in processing and that can reject any counterfeit coin that closely resembles a genuine coin, or a counterfeit coin that has a distribution that partially overlaps into a genuine-coin identification region, without reducing the acceptance ratio of genuine coins. It also provides an inexpensive apparatus that utilizes this method.

MEANS OF SOLVING THE PROBLEM

In order to achieve the above objective, the present invention provides a method for determining the authenticity of a coin based on measured values detected by a first sensor means and a second sensor means having different detection functions and being provided along a predetermined path along which the coin to be identified is passing, the method being characterized in comprising the steps of: detecting by the first sensor means a first measured value that expresses a first characteristic of the coin; detecting by the second sensor means a second measured value that expresses a second characteristic of the coin; providing a first region that defines a comparison reference for preliminarily identifying the coin, based on the first and second measured values; providing at least one more second region for the first and second measured values such that it is included in the first region; performing a preliminary determination by comparison so as to determine whether or not the first and second measured values lie within the second region; if, as a result of the preliminary determination, either of the first and second measured values is found to lie within the second region, comparing the first and second measured values with the first region; and performing an authenticity determination by determining whether or not the first and second measured values lie within the first region.

The present invention also provides a method for determining the authenticity of a coin based on measured values detected by a first sensor means and a second sensor means having different detection functions and being provided along a predetermined path along which the coin to be identified is passing, the method being characterized in comprising the steps of: detecting by the first sensor means a first measured value that expresses a first characteristic of the coin; detecting by the second sensor means a second measured value that expresses a second characteristic of the coin; providing a comparison reference region for identifying the coin, based on the first and second measured values; providing at least one group of threshold regions that are each a combination of the first and second measured values, such that the threshold regions are partially within the comparison reference region; providing a preliminary determination step by comparison to determine whether or not the first and second measured values exceed the threshold region; and, if the first and second measured values exceed the threshold region, comparing the first and second measured values with the comparison reference region, and determining the authenticity of the coin by determining whether or not the first and second measured values lie within the comparison reference region.

The present invention further provides an apparatus for identifying coins, comprising: a coin path along which a coin passes; a sensor means provided along the coin path, for detecting a first characteristic of the coin passing along the coin path; a sensor means provided along the coin path, for detecting a second characteristic of the coin passing along the coin path; a first setting means that sets a first region defining a comparison reference for identifying the coin based on a first measured value from the first sensor means and a second measured value from the second sensor means; a second setting means that sets a second region included within the first region; a preliminary determination means that performs a preliminary determination as to whether or not the measured values detected by the first and second sensor means lie within the second region; and a determination means that, if the preliminary determination means determines that the measured values lie within the second region, performs a determination as to whether or not the measured values lie within the first region.

The present invention further provides an apparatus for identifying coins, characterized in that the apparatus comprises: a coin path along which a coin passes; a sensor means provided along the coin path, for detecting a first characteristic of the coin passing along the coin path; a sensor means provided along the coin path, for detecting a second characteristic of the coin passing along the coin path; a first setting means that sets a first region defining a comparison reference for identifying the coin based on a first measured value from the first sensor means and a second measured value from the second sensor means; a second setting means that sets a threshold region that is partially included within the comparison reference region; a preliminary determination means that performs a preliminary determination as to whether or not the measured values detected by the first and second sensor means lie within the threshold region; and a determination means that, if the preliminary determination means determines that the measured values lie within the threshold region, performs a determination as to whether or not the measured values lie within the comparison reference region.

OPERATION OF THE PRESENT INVENTION

In the method of the present invention, a preliminary determination is made to find out whether or not the measured values detected by the first and second sensor means lie within the second region which has been set to be included within the first region that defines a comparison reference for coin identification. If the values do lie within this region, the coin is determined to be a counterfeit; if they do not lie within this region, a genuine-coin identification is performed to find out whether or not they lie within the first region.

In the method of the present invention, a comparison reference region that corresponds to the first region of the method of claim 1 is set and a first threshold region that partially intrudes into the comparison reference region is used instead of the second region of the method of claim 1 in the identification of the genuine coin.

The apparatus of the present invention performs a coin authenticity identification based on the method of claim 1.

The apparatus of the present invention also performs a coin authenticity identification based on the method of claim 2.

DETAILED DESCRIPTION OF THE PREFERRED EMBODIMENT

Figure 1:
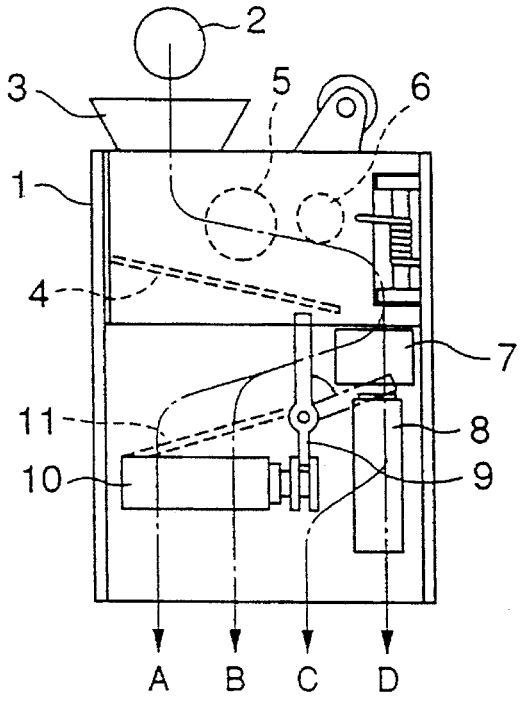
FIG. 1 is a front view of one embodiment of a coin-identifying apparatus in accordance with the present invention.

An embodiment of the coin-identifying apparatus in accordance with the present invention will be described below with reference to FIG. 1. This figure shows that an insertion slot 3 for a coin 2 is provided at an upper part of a coin-identifying apparatus 1. A coin 2 inserted into the insertion slot 3 is led onward from the insertion slot 3, in other words it is led to the right in the figure, and drops onto a downward-slanting first rail 4. The coin 2 that has dropped onto the first rail 4 falls toward a downstream side along the first rail 4 in accordance with the slant of the first rail 4, while rotating.

A first sensor 5 and a second sensor 6 are arranged partway along the first rail 4, and coin-identifying processing that determines the authenticity and denomination of the coin 2 is performed based on the results of measurements performed by the first sensor 5 and the second sensor 6.

Depending on whether the coin-identifying processing determines that the inserted coin 2 is genuine or a counterfeit, a first solenoid 8 either activates or remains inactive, and thus a first gate 7 either operates or doesn't operate.

If as the result of the coin-identifying processing the coin 2 is determined to be genuine, the first solenoid 8 (which is designed to guide the coin 2 into a genuine-coin path that is not shown in the figure) is activated, and thus the first gate 7 operates to guide the coin 2 into the genuine-coin path.

If, however, as the result of the coin-identifying processing the coin 2 is determined to be a counterfeit, the first solenoid 8 is not activated, in order to guide the coin 2 into a return path that is not shown in the figure. This ensures that the first gate 7 does not operate and thus the coin 2 is guided into the return path.

The operation when the result of the coin-identifying processing determines that the coin 2 is genuine will now be described. Note that the embodiment shown in FIG. 1 illustrates a distributive configuration that identifies coins of four acceptable denominations.

After the coin 2 has been guided into the genuine-coin path (not shown in the figure) in accordance with the above tentative identification, a second solenoid 10 is activated based on a denomination identification result of the coin-identifying processing, a second gate 9 is operated thereby, and thus the coin 2 is sent to join either a group comprising a denomination A and a denomination B or a group comprising a denomination C and a denomination D.

In other words, if the coin 2 is of denomination A or B, the second solenoid 10 is activated so that the second gate 9 rotates in the clockwise direction (as seen in FIG. 1) to open a denomination A or B path. This guides the coin 2 along a second rail 11.

If, however, the coin 2 is of denomination C or denomination D, the second solenoid 10 is not activated, and thus the second gate 9 remains in a position in which it is urged in the counterclockwise direction (as seen in FIG. 1), to open a denomination C or D path. This causes the coin 2 to drop downward into the denomination C or D path.

If the coin 2 is of denomination A or B, and has therefore been guided along the second rail 11, it is further guided along a path A or a path B in accordance with its diameter, and is ejected through an appropriate ejection slot that is not shown in the figure.

If, however, the coin 2 is of denomination C or D and has therefore dropped downward along the genuine-coin path (not shown in the figure), however, it is further guided along a path C or a path D in accordance with its diameter, and is ejected through an appropriate ejection slot that is not shown in the figure.

Figure 5:
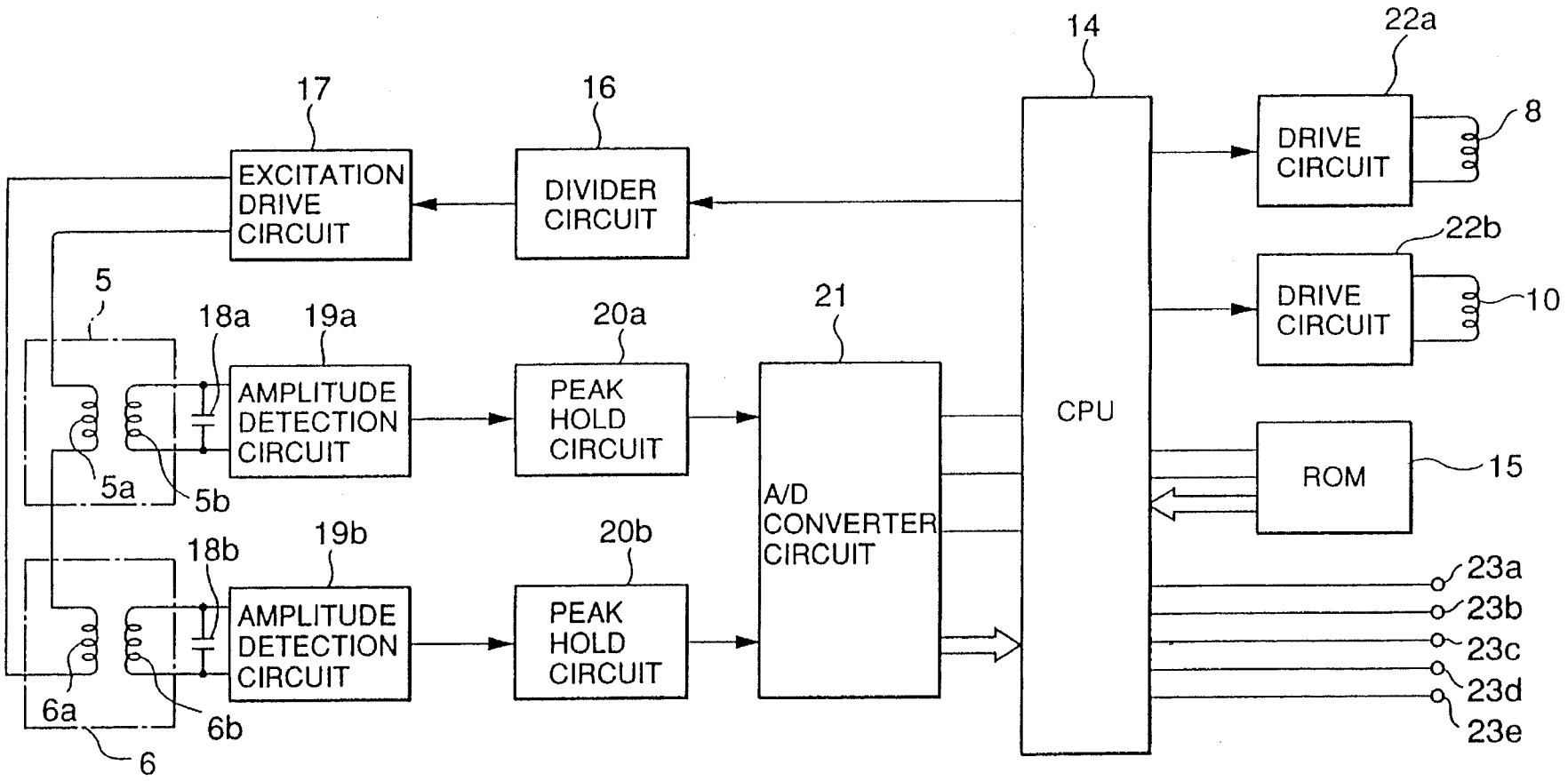
FIG. 5 is a block diagram of one embodiment of the circuitry used to identify coins in accordance with the present invention.

A block diagram of the circuit configuration of this embodiment of the present invention is shown in FIG. 5. In this figure, the first sensor 5 and the second sensor 6 are such that, when a high-frequency electromagnetic field is applied to the coin by using an inductor means, the mutual action between the electromagnetic field and the coin is used in the detection.

The first sensor 5 could be, for example, such that it outputs an electrical signal that changes in response to the material of the coin. On the other hand, the second sensor 6 could be, for example, such that it outputs an electrical signal in response to the diameter of the coin.

The configuration of each of the first sensor 5 and the second sensor 6 is such that excitation coils 5*a* and 6*a* are positioned opposite corresponding receiver coils 5*b* and 6*b*, with the coin path (not shown in the figure) therebetween.

The configuration of the above inductor means is that shown with respect to the present embodiment, but it should be obvious to those skilled in the art that a similar means such as that disclosed in U.S. Pat. No. 5,078,252 could be used instead.

The excitation coils 5*a* and 6*a* shown in FIG. 5 are connected in series, and they are also connected to the output of an excitation drive circuit 17. A reference frequency pulse signal output from a CPU 14 is divided by a divider circuit 16 and is then input to the excitation drive circuit 17 as an AC signal of, for example, 20 to 60 kHz. The excitation drive circuit 17 amplifies the AC signal to drive each of the excitation coils 5*a* and 6*a*.

The receiver coil 5*b*, on the other hand, is connected in parallel to a resonance capacitor 18*a*, and the connection points thereof are connected to the inputs of an amplitude detection circuit 19*a*. Similarly, the receiver coil 6*b* is connected in parallel to a resonance capacitor 18*b*, and the connection points thereof are connected to the inputs of an amplitude detection circuit 19*b*.

The amplitude detection circuit 19*a* is designed to detect the amplitude of a high-frequency signal induced in the receiver coil 5*b*, and an envelope superimposed on a high-frequency signal is output from the amplitude detection circuit 19*a*, in a manner well known in the art, by the interaction generated between the coin 2 and the inductor means. The detection output from the amplitude detection circuit 19*a* is then input to a peak hold circuit 20*a*.

The peak hold circuit 20*a* inputs the detection output from the amplitude detection circuit 19*a*, creates a peak voltage signal in correspondence to the output from the amplitude detection circuit 19*a*, and outputs it to an A/D converter circuit 21.

The peak voltage signal of the peak hold circuit 20*a* that is input to the A/D converter circuit 21 is converted by the A/D converter circuit 21 into a corresponding digital voltage signal that is output to the CPU 14.

In a similar way, the amplitude of a high-frequency signal from the receiver coil 6*b* is detected by the amplitude detection circuit 19*b* and a corresponding peak voltage signal is created by a peak hold circuit 20*b*, then that peak voltage signal is converted by the A/D converter circuit 21 into a corresponding digital signal that is output to the CPU 14.

The CPU 14 uses a method that will be described below to determine whether the inserted coin 2 is genuine or a counterfeit, based on the digital voltage signals that express the characteristics of the coin 2 in the optimal manner and that were obtained by the mutual interactions between the first sensor 5 and the second sensor 6 with the coin 2. If the coin is genuine, the first solenoid 8 is activated via a drive circuit 22*a*.

It also determines which of denominations A to D that the coin 2 belongs to and, if it is denomination A or B, the second solenoid 10 is activated via a drive circuit 22*b*.

Input-output pins 23*a* to 23*e* of the CPU 14 act as an interface with other equipment such as a coin changer.

The components that form the main elements of the present invention will be described in more detail below, with reference to a comparison between FIG. 2 to FIG. 4, which illustrate the concepts of one embodiment in accordance with the present invention, and FIG. 6 and FIG. 7, which illustrate the concept of the prior art technology.

First, the graphs in each of FIG. 2 to FIG. 4, FIG. 6, and FIG. 7 show both an identification region for a specific genuine coin and a distribution region for a specific very similar coin that closely resembles the genuine coin, extending along both the X and Y axes.

In this case, the specific genuine coin is, for example, a German two-mark piece, and the specific very similar coin is, for example, a Hungarian 20-florint piece.

A Hungarian 20-florint piece closely resembles a German two-mark piece in material and dimensions. The distribution shown in each of FIG. 2 to FIG. 4, FIG. 6, and FIG. 7 indicate a conceptualization based on values obtained by using the apparatus in accordance with the present invention to measure both coins, wherein values along the X axis in each figure correspond to values obtained from the first sensor 5, for example, and those along the Y axis correspond to values obtained from the second sensor 6.

Figure 2:
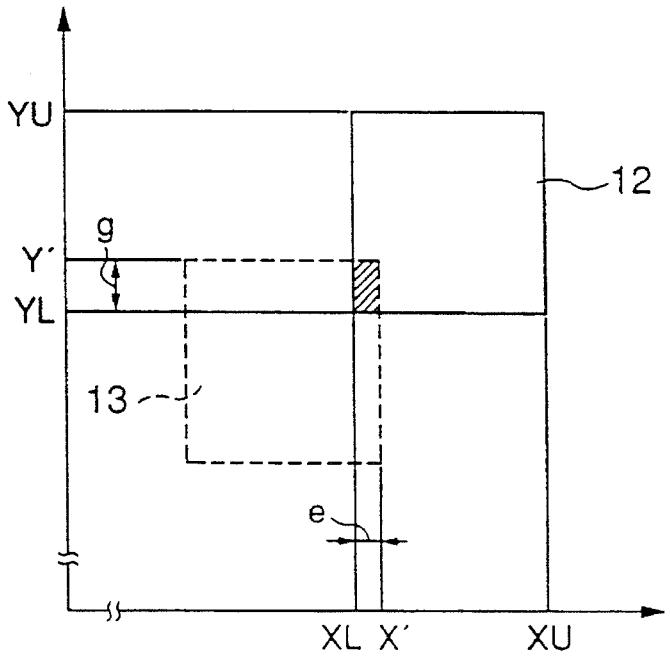
FIG. 2 is a conceptual diagram of the main components of the coin-identifying apparatus in accordance with the present invention.

In FIG. 2, a counterfeit distribution region 13 is shown partially overlapping (at the hatched area) a genuine-coin identification region 12.

Figure 6:
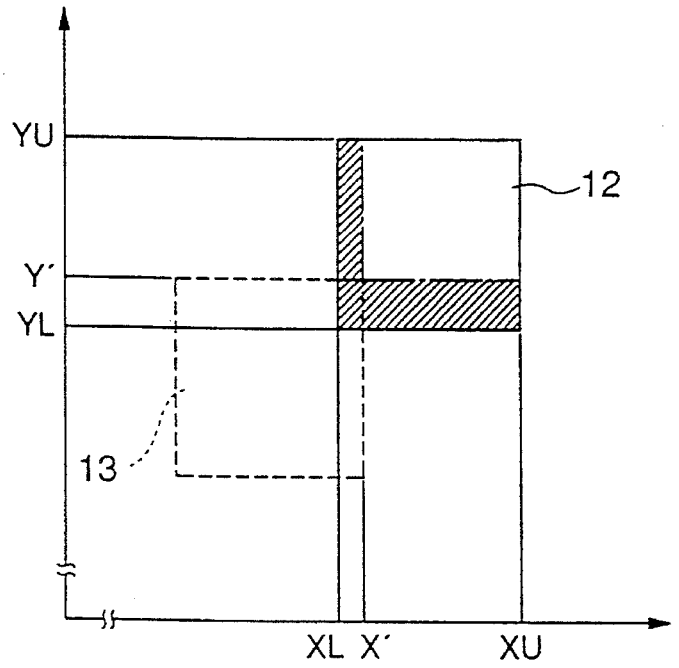
FIG.6 PRIOR ART
FIG. 6 is a conceptual diagram of a conventional coin-identification method.
Figure 7:
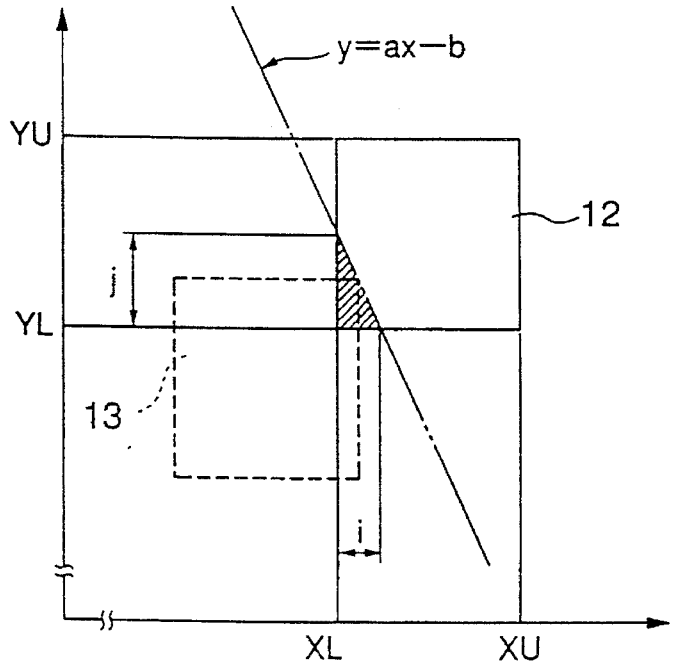
FIG.7 PRIOR ART
FIG. 7 is conceptual diagram of another conventional coin-identification method.

Counterfeit coins that fall into this overlapping area ought to be rejected, and so, in order to reject such counterfeit coins in the prior art, the hatched area shown in FIG. 6 or FIG. 7 is set as a rejection region.

If the ratio of the hatched rejection region to the genuine-coin identification region 12 in the prior art of FIG. 6 is assumed to be S1, it is defined as follows:

$$S_1 = \frac{\{(XU - X') \times (Y' - YL)\} + \{(X' - XL) \times (Y' - YL)\} + \{(X' - XL) \times (YU - Y')\}}{\{(XU - XL) \times (YU - YL)\}} \times 100 \quad (1)$$

If the ratio of the hatched rejection region to the genuine-coin identification region 12 in the prior art of FIG. 7 is assumed to be 2, it is defined as follows:

$$S_2 = \frac{\{(i \times j)/2\}}{\{(XU - XL) \times (YU - YL)\}} \times 100 \quad (2)$$

On the other hand, if the ratio of the hatched rejection regions to the genuine-coin identification region 12 in the embodiment of the present invention shown in FIG. 2 is assumed to be S3, it is defined as follows:

$$S_3 = \frac{(e \times g)}{\{(XU - XL) \times (YU - YL)\}} \times 100 \quad (3)$$

If the ratios given by Equations (1) to (3) are compared, the proportions of the genuine-coin identification region 12 lost to the hatched rejection region are such that: S1 >S2>S3.

Therefore, it is clear from the above relationship that the present invention can enable accurate rejection of counterfeit coins that closely resemble the genuine coins, without lowering the acceptance ratio of genuine coins.

When the coin 2 is being authenticated, based on values measured by the first sensor 5 and the second sensor 6 from the coin 2, a preliminary check is first performed on these values to determine whether or not they lie within the shaded region shown in FIG. 2.

The method used for this preliminary check is such that the measured value obtained by the first sensor 5 is compared with an upper-limit value X' and a lower limit value XL that define a comparison reference for the preliminary check shown along the X axis in FIG. 2, and the measured value obtained by the second sensor 6 is compared with an upper-limit value Y' and a lower limit value YL that define a comparison reference for the preliminary check shown along the Y axis in FIG. 2, using techniques known in the art. The preliminary check thus determines whether or not these measured values of the coin 2 lie in the shaded region.

If the result of the preliminary check determines that either of the measured values does not lie in the shaded region, each of the measured values is then compared with a corresponding pair of an upper-limit value XU and the lower-limit value XL that define a comparison reference for verification determination shown along the X axis in FIG. 2, and an upper-limit value YU and the lower-limit value YL along the Y axis, and thus an authenticity determination is performed by checking whether or not the measured values of the coin 2 lie within the genuine-coin identification region.

Figure 8:
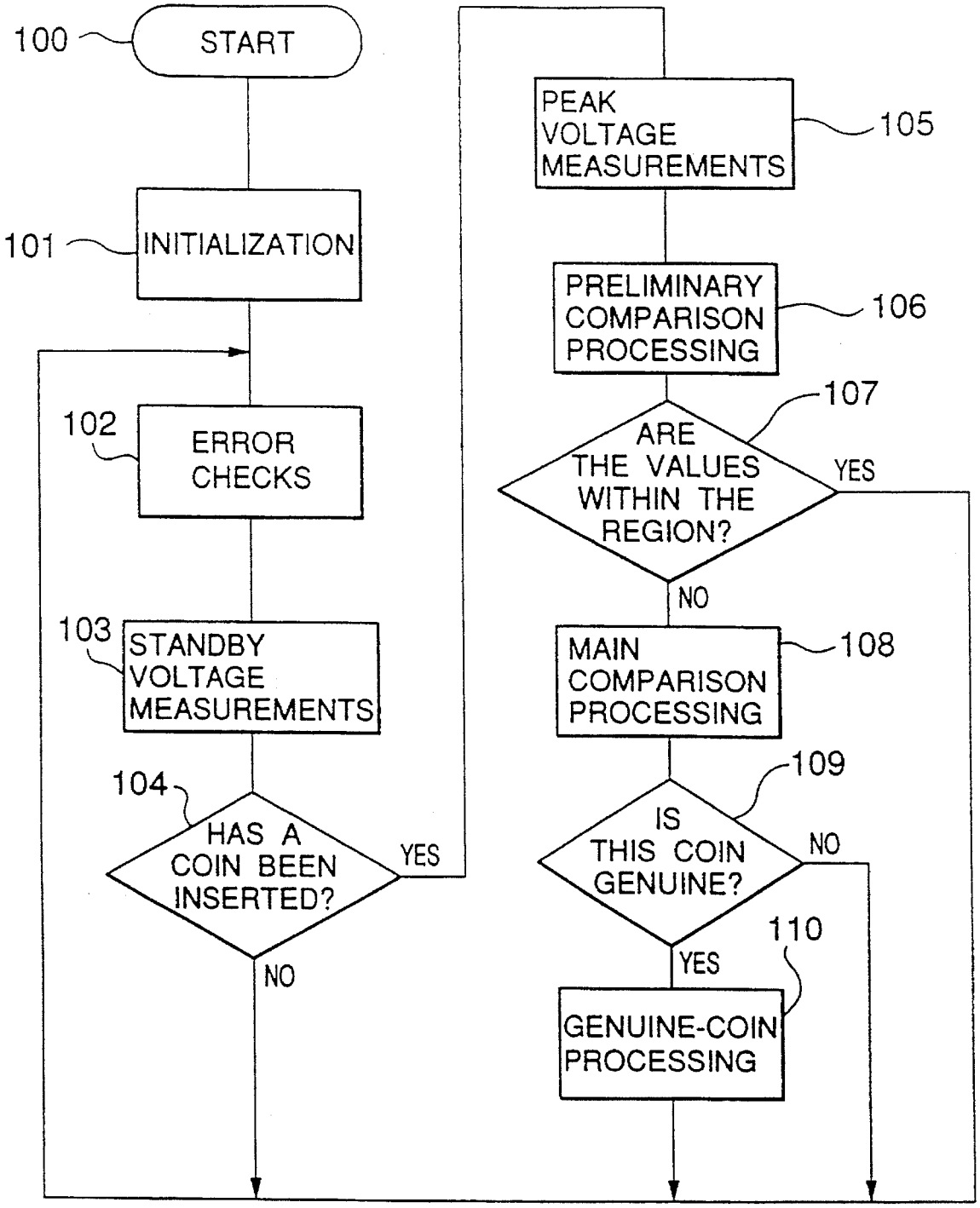
FIG. 8 is a flowchart of the operations of distinguishing and identifying coins in accordance with the present invention.

Next, the coin identification processing provided by the CPU 14 shown in FIG. 5 will be described with reference to the flowchart of FIG. 8.

When the coin-identifying apparatus 1 is turned on (step 100 in FIG. 8), the CPU 14 executes processing in accordance with a procedure that was previously programmed into a ROM 15.

The CPU 14 first initializes its internal registers (step 101), then performs various error checks (step 102) and measures standby voltages from each of the first sensor 5 and the second sensor 6 (step 103).

These measured values of the standby voltages are used for determining whether or not threshold values that were previously set by the decision processing of a step 104 have been exceeded. In this case, after the program has executed step 103, it executes the decision processing of step 104.

If the decision processing of step 104 determines that the measured values of the standby voltages has exceeded the previously set threshold values, the flow proceeds along the "yes" branch to the peak voltage measurement processing of a step 105.

If, however, the decision processing of step 104 determines that the measured values of the standby voltages has not exceeded the previously set threshold values, the flow proceeds along the "no" branch back to the error check of step 102 to repeat this predetermined loop. For the purposes of this description, the result of the decision of step 104 is assumed to be "yes" and the flow proceeds.

After the decision processing of step 104, the program executes the peak voltage measurement of step 105.

This peak voltage measurement is executed in such a manner that the coin is measured by the first sensor 5 and the second sensor 6 to express the thus-obtained characteristics of the coin 2 in the optimal way, the voltages indicated by the peak hold circuits 20 shown in FIG. 5 are digitized by the A/D converter circuit 21, and the thus-obtained peak voltage values are temporarily stored in the CPU 14. After the program has executed step 105, it proceeds to a step 106.

The preliminary comparison processing of step 106 is such that the measured peak voltage values are compared with the corresponding upper- and lower-limit values along the X axis and the upper- and lower-limit values along the Y axis that define the shaded region of FIG. 2, and a preliminary flag is created based on the result of this comparison. After the program has executed step 106, it proceeds to a step 107 in which decision processing is executed.

The decision processing of step 107 is such that the flow branches in accordance with the details of the preliminary flag set in step 106, so that, if the measured peak voltage values do not lie within the shaded region shown in FIG. 2, the flow branches to "no" and a step 108 in which main comparison processing is executed. If, however, the measured peak voltage values do lie in the shaded region shown in FIG. 2, the flow returns to the coin authenticity decision standby loop.

For the purposes of this description, the result of the decision of step 107 is assumed to be "no" and the flow proceeds. After the program has executed step 107, it proceeds to a step 108 in which the main comparison processing is executed.

The preliminary comparison processing of step 108 is such that the measured peak voltage values are compared to determine whether they lie within the genuine-coin identification region shown in FIG. 2, and a genuine-coin flag is created based on the result of this comparison. After the program has executed step 108, it proceeds to a step 109 in which decision processing is executed.

The decision processing of step 109 is such that the coin 2 is determined to be a genuine coin or a counterfeit, based on the genuine-coin flag set in step 108, and, at the same time, its denomination is determined.

If the result of the decision of step 109 is that the coin 2 is genuine, the flow branches to "yes" and genuine-coin processing is executed in a step 110. If, however, the coin is determined to be a counterfeit, the flow branches to "no" and returns to the standby loop.

For the purposes of this description, the result of the decision processing of step 109 is assumed to be "yes" and the flow proceeds to a step 110 in which genuine-coin processing is executed.

The processing of step 110 is such that the first solenoid 8 and the second solenoid 10 shown in FIG. 5 are operated based on the decision result of step 109, a denomination-type signal for the genuine-coin determination is output to the input-output pins 23, and the flow returns to the standby loop.

The identification processing procedure described above is repeated to determine whether or not each inserted coin is genuine, with respect to previously specified denominations.

Figure 3:
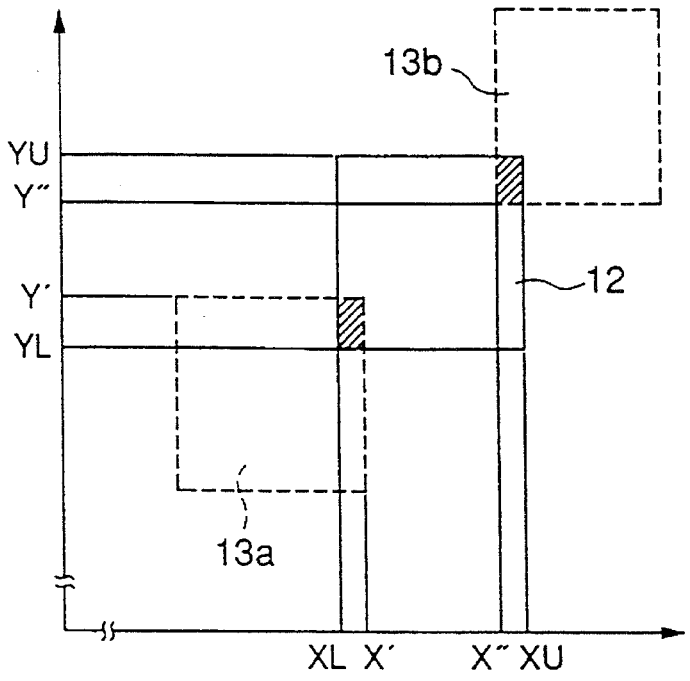
FIG. 3 is another conceptual diagram of the main components of the coin-identifying apparatus in accordance with the present invention.
Figure 4:
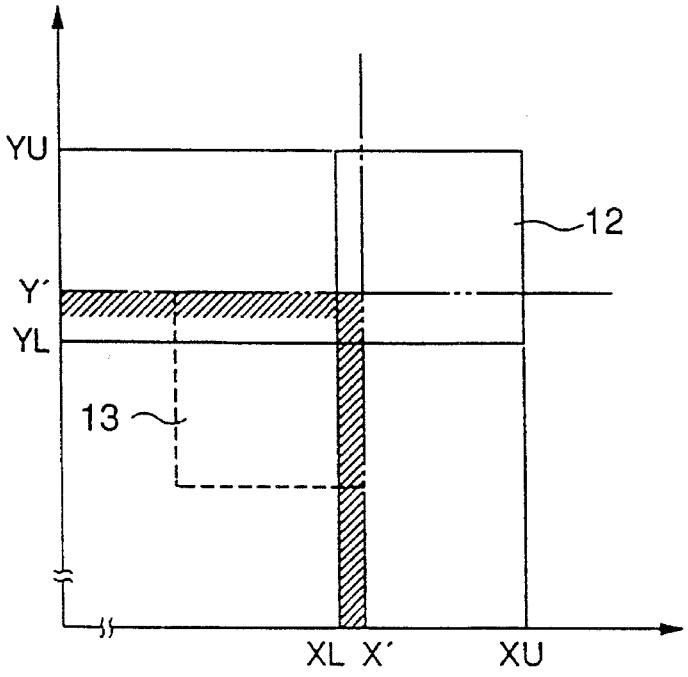
FIG. 4 is a further conceptual diagram of the main components of the coin-identifying apparatus in accordance with the present invention.

Note that the embodiment described above used FIG. 2 to illustrate the concept of the main elements of the present invention, but it should be obvious to those skilled in the art that the concept of the present invention is not limited to FIG. 2; it also includes the methods shown in FIG. 3 and FIG. 4 as well.

The conceptual diagram of FIG. 3 illustrates another embodiment of the present invention in which two preliminary check regions are provided within the genuine-coin identification region 12.

Another method in accordance with the present invention is shown in FIG. 4, as another method for rejecting counterfeit coins distributed within the genuine-coin identification region 12. This method in accordance with the present invention performs a preliminary determination by comparing the magnitudes of peak voltage values against the threshold value X' provided on the X axis and the threshold value Y' provided on the Y axis, and by determining whether or not they lie within an image limit area expressed by the intersection between the threshold value X' and the threshold value Y'.

EFFECT OF THE PRESENT INVENTION

When a counterfeit coin which is extremely close to the genuine-coin identification region, or which has a distribution that partially intrudes into the genuine-coin identification region, is to be rejected, the present invention presents improvements over the prior art which has problems in that, since the rejection region is set to be large, the acceptance ratio of genuine coins is low and in that complicated function calculations are required in order to reject counterfeit coins that are distributed in the rejection region.

In other words, the present invention makes it possible to set a smaller rejection region, and also enables rapid processing by performing a preliminary determination that is a simple magnitude comparison, removing the necessity of complicated function calculations. This ensures that the present invention provides a coin-identification method that has an extremely high identification capability, and an inexpensive apparatus that utilizes that method.

What is claimed is:

1. In a method for determining the authenticity of a coin based on measured values detected by a first sensor means and a second sensor means having different detection functions and being provided along a predetermined path along which said coin to be identified is passing, a method comprising the steps of:

detecting by said first sensor means a first measured value that expresses a first characteristic of said coin;

detecting by said second sensor means a second measured value that expresses a second characteristic of said coin;

providing a first region that defines a comparison reference for preliminarily identifying said coin, based on the first and second measured values;

providing at least one second region for the first and second measured values such that it is included in said first region;

performing a preliminary determination by comparison so as to determine whether or not the first and second measured values lie within said second region;

determining that said coin is a counterfeit when both of the first and second measured values are found to lie within said second region as a result of the preliminary determination; and if either of the first and second measured values are not in the second region, comparing the first and second measured values with said first region so as to perform an authenticity determination by determining whether or not the first and second measured values lie within the first region.

2. In a method for determining the authenticity of a coin based on measured values detected by a first sensor means and a second sensor means having different detection functions and being provided along a predetermined path along which said coin to be identified is passing, a method comprising the steps of:

detecting by said first sensor means a first measured value that expresses a first characteristic of said coin;

detecting by said second sensor means a second measured value that expresses a second characteristic of said coin;

providing a comparison reference region for identifying said coin, based on the first and second measured values;

providing at least one group of threshold regions that are each a combination of the first and second measured values, such that the threshold regions are partially within the comparison reference region;

providing a preliminary determination step by comparison to determine whether or not the first and second measured values exceed the threshold regions;

determining that said coin is a counterfeit when both of the first and second measured values do not exceed the threshold regions as a result of the preliminary determination; and if either of the first and second measured values exceed the threshold regions, comparing the first and second measured values with the comparison reference region so as to determine the authenticity of said coin by determining whether or not the first and second measured values lie within the comparison reference region.

3. An apparatus for identifying coins, comprising:

a coin path along which a coin passes;

a first sensor means provided along said coin path, for detecting a first characteristic of said coin passing along said coin path;

a second sensor means provided along said coin path, for detecting a second characteristic of said coin passing along said coin path;

a first setting means that sets a first region defining a comparison reference for identifying said coin based on a first measured value from said first sensor means and a second measured value from said second sensor means;

a second setting means that sets a second region included within the first region;

a preliminary determination means that performs a preliminary determination as to whether or not the measured values detected by said first and second sensor means lie within the second region; and a determination means that, if said preliminary determination means determines that the measured values lie within said second region, determines said coin is a counterfeit as a result of the preliminary determination, and if the preliminary determination means determines that if either of the measured values do not lie within the second region, performs a determination as to whether or not the measured values lies within the first region.

4. A coin-identifying apparatus in accordance with claim 3, wherein a sensor means for detecting coins uses an electromagnetic induction coil.

5. A coin-identifying apparatus in accordance with claim 3, wherein said first and second sensor means perform detections based on at least two different parameters.

6. A coin-identifying apparatus in accordance with claim 3, wherein one of said first and second sensor means is a sensor means that uses an electromagnetic induction coil and the other of said first and second sensor means uses said coin and an optical sensor.

7. A coin-identifying apparatus in accordance with claim 3, wherein one dimension of the first and second regions is determined by a material of said coin, and wherein another dimension of the first and second regions is determined by a diameter of said coin.

8. An apparatus for identifying coins, comprising:

a coin path along which a coin passes;

a first sensor means provided along said coin path, for detecting a first characteristic of said coin passing along said coin path;

a second sensor means provided along said coin path, for detecting a second characteristic of said coin passing along said coin path;

a first setting means that sets a first region defining a comparison reference for identifying said coin based on a first measured value from said first sensor means and a second measured value from said second sensor means;

a second setting means that sets a threshold region that is partially included within the comparison reference region;

a preliminary determination means that performs a preliminary determination as to whether or not the measured values detected by said first and second sensor means exceed the threshold region; and a determination means that, if said preliminary determination means determines that both the first and second measured values do not exceed the threshold region, determines that said coin is a counterfeit as a result of the preliminary determination, and if said preliminary determination means determine that if either of the first and second measured values exceed the threshold region, performs a determination as to whether or not the measured values lie within the comparison reference region.

9. A coin-identifying apparatus in accordance with claim 4, wherein one dimension of the comparisons reference and threshold regions is determined by a material of said coin, and wherein another dimension of the comparisons reference and threshold regions is determined by a diameter of said coin.

10. An apparatus for identifying coins, comprising:

a coin path along which a coin passes;

a first sensor provided along the coin path that detects a first characteristic of the coin passing along the coin path;

a second sensor provided along the coin path that detects a second characteristic of the coin passing along the coin path;

a first setting circuit that sets a first region defining a comparison reference for preliminary identifying the coin based on a first measured value from the first sensor and a second measured value from the second sensor;

a second setting circuit that sets a second region included within the first region;

a preliminary determination circuit that performs a preliminary determination as to whether or not the measured values detected by the first and second sensors lie within the second region; and a determination circuit that determines the coin is a counterfeit as a result of the preliminary determination when the preliminary determination circuit determines that both the measured values lie within said second region, the determination circuit performing a tentative authenticity determination as to whether or not the measured values lie within the first region when the preliminary determination circuit determines that either of the measured values do not lie within the second region.

11. A coin-identifying apparatus in accordance with claim 10, wherein the sensors for detecting coins use an electromagnetic induction coil.

12. A coin-identifying apparatus in accordance with claim 10, wherein the first and second sensors perform detections based on at least two different parameters.

13. A coin-identifying apparatus in accordance with claim 10, wherein one of the first and second sensors is a sensor that uses an electromagnetic induction coil and the other of the first and second sensors uses an optical sensor.

14. A coin-identifying apparatus in accordance with claim 10, wherein one dimension of the first and second regions is determined by a material of the coin, and wherein another dimension of the first and second regions is determined by a diameter of the coin.

* * * * *